US006431895B1

(12) United States Patent
Hung

(10) Patent No.: US 6,431,895 B1
(45) Date of Patent: Aug. 13, 2002

(54) FLUORESCENT TUBE BASE WITH TERMINAL SHORTING CLIP

(76) Inventor: Tang-Yueh Hung, No. 192, Shu Ren Road, Wu Feng Hsian, Taichung Hsien (TW)

( * ) Notice: Subject to any disclaimer, the term of this patent is extended or adjusted under 35 U.S.C. 154(b) by 0 days.

(21) Appl. No.: 09/340,210

(22) Filed: Jun. 28, 1999

(51) Int. Cl.[7] ..... H01R 33/02; H01R 31/08
(52) U.S. Cl. ..... 439/241; 439/189; 439/511
(58) Field of Search ..... 439/441, 439, 439/231, 242, 243, 189, 235, 511; 315/51–59

(56) References Cited

U.S. PATENT DOCUMENTS 2,295,757 A * 9/1942 Russell ..... 439/241
2,441,929 A * 5/1948 Bert ..... 439/241
3,654,587 A * 4/1972 McLaughlin ..... 439/241
3,731,254 A * 5/1973 Key
4,171,861 A * 10/1979 Hohorst
4,456,317 A * 6/1984 McCleerey
4,582,377 A * 4/1986 Wilmes
6,039,597 A * 3/2000 Getselis et al. ..... 439/441

* cited by examiner

*Primary Examiner*—Neil Abrams
(74) *Attorney, Agent, or Firm*—Browdy and Neimark, P.L.L.C.

(57) ABSTRACT

A fluorescent tube base comprises a body and a cover detachably attached to the body. The body is provided with two conductive pieces and a bridging or shorting piece connecting the two conductive pieces. The conductive pieces are provided with a through hole. The bridging piece is provided with two connection ends. The two conductive pieces are connected by the bridging piece such that the two connection ends of the bridging piece are inserted into the through holes of the two conductive pieces. With such assembly, a conventional tube base may be used for joining florescent tubes in parallel.

10 Claims, 4 Drawing Sheets

FLUORESCENT TUBE BASE WITH TERMINAL SHORTING CLIP

FIELD OF THE INVENTION

The present invention relates generally to a fluorescent tube (1 amp), and more particularly to an end base of the fluorescent tube.

BACKGROUND OF THE INVENTION

As shown in FIG. 1, a fluorescent tube base 80 of the prior art has a seat 1 and a cover plate 91. The seat 81 is provided with a long slot 82 and two locating tapers 83. A conductive bridging piece 84 is disposed in the long slot 82 and provided with two springs 85 conductive to electricity so as to permit engagement of bases for use in electrically connecting two fluorescent tubes in parallel. Two conductive pieces 86 are provided at one end thereof with a locating slot 87 corresponding in location to and engageable with the taper 83 for holding the wire inserted thereinto from the seat 81. The two conductive pieces 86 are received in the seat 81 such that the conductive pieces 86 are urged by the two springs 85. The cover plate 91 has a hooked piece 92 which is engaged with a retaining portion 89 of the seat 81 when the cover plate 91 is joined with the seat 81. The two conductive pieces 86 are located by the cover plate 91.

Such a fluorescent tube base of the prior art as described above is not entirely effective in design in that it comprises two springs 85 which come in contact with the conductive bridging piece 84 and the conductive pieces 86 and are susceptible to fatigue, thereby resulting in a poor connection. In addition, the locating slot 87 of the conductive pieces 86 is structurally weak and thus incapable of locating the electric wire securely. Even though the cover plate 91 is detachable fastened with the seat 81, the cover plate 91 can not be easily separated from the seat 81.

SUMMARY OF THE INVENTION

It is therefore the primary objective of the present invention to provide a fluorescent tube base with conductive pieces which have an excellent conductive effect.

It is another objective of the present invention to provide a fluorescent tube base with a means for holding the electrical wire securely.

It is still another objective of the present invention to provide a fluorescent tube base which can be easily assembled and disassembled.

In keeping with the principle of the present invention, the foregoing objectives of the present invention are attained by a fluorescent tube base comprising a body and a cover. The body is provided with two conductive pieces, which are connected by a conductive bridging piece and are provided with a through hole in which a connection end of the conductive pieces is securely received to ensure the conductive pieces have an excellent conductive effect. The cover is detachably fastened with the body.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
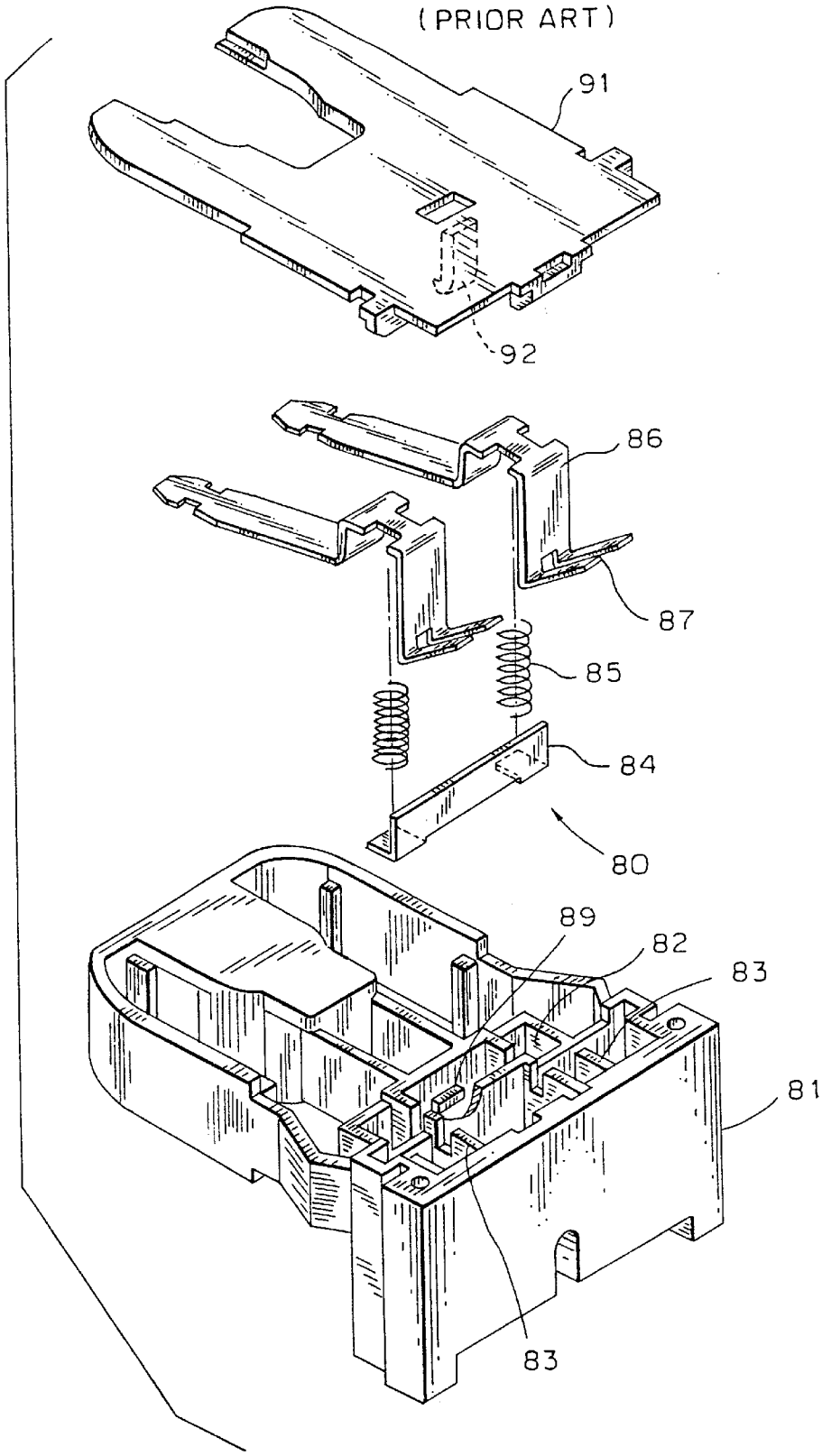
FIG. 1 (PRIOR ART)
FIG. 1 shows an exploded view of a fluorescent tube base of the prior art.
Figure 2:
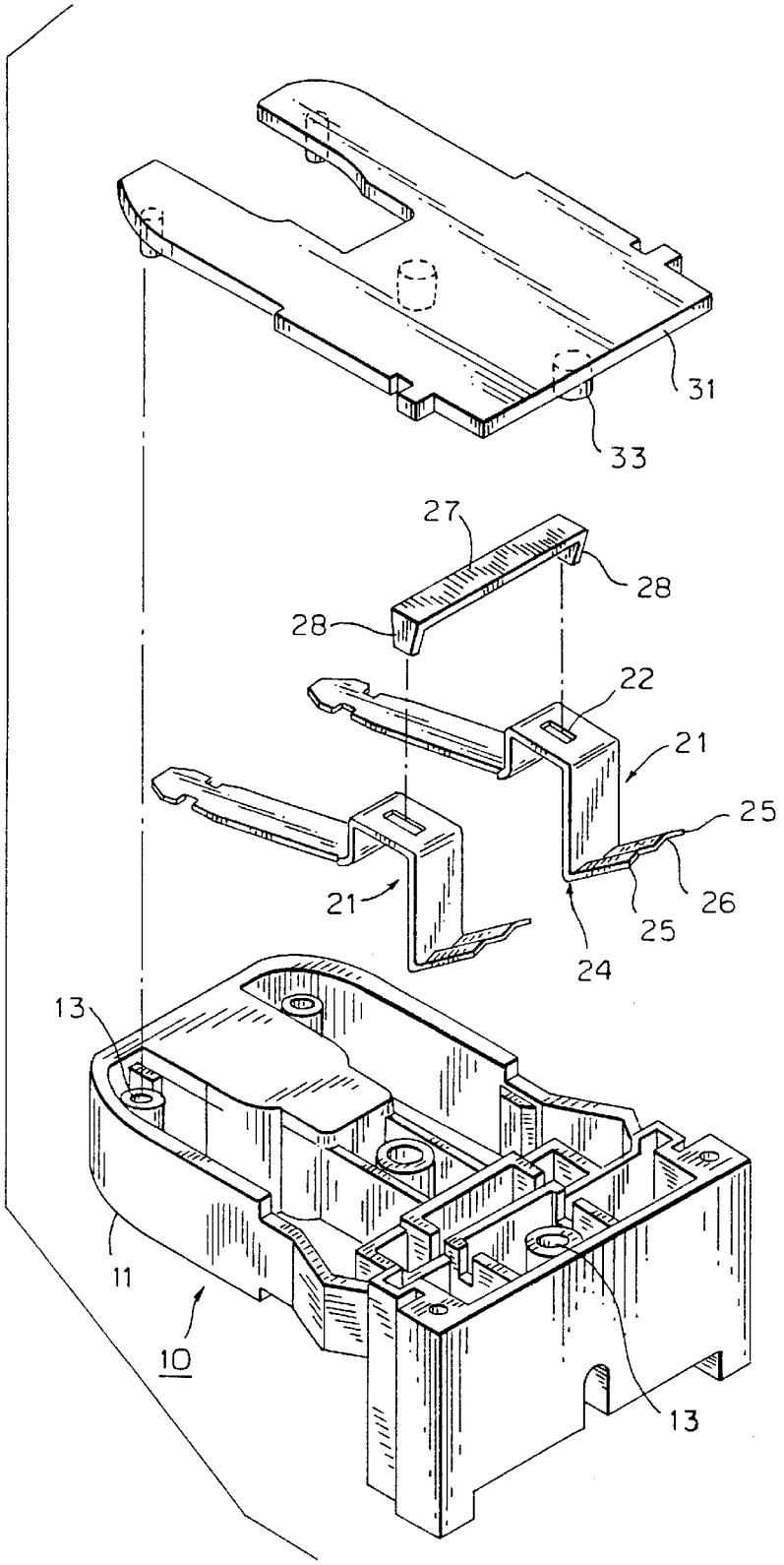
FIG. 2 shows an exploded view of a fluorescent tube base of the present invention.
Figure 3:
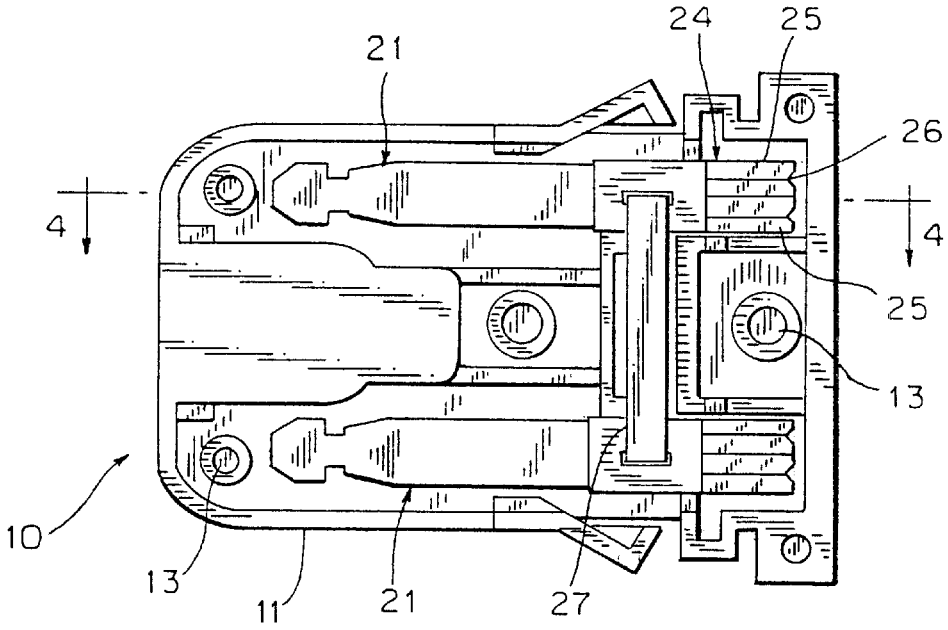
FIG. 3 shows a schematic view of the body of the present invention in combination.
Figure 4:
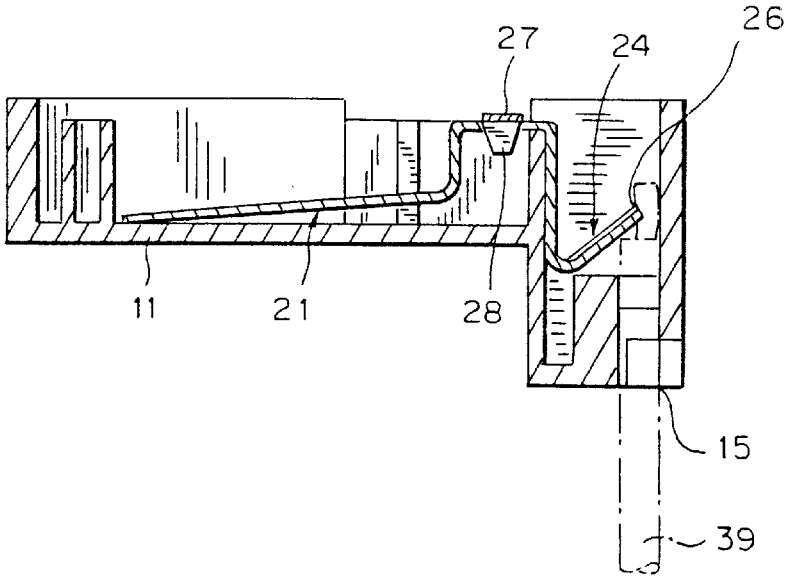
FIG. 4 shows a sectional view of a portion taken along a line 4—4 as shown in FIG. 3, with imaginary lines being indicative of an electrical wire connected with the present invention.
Figure 5:
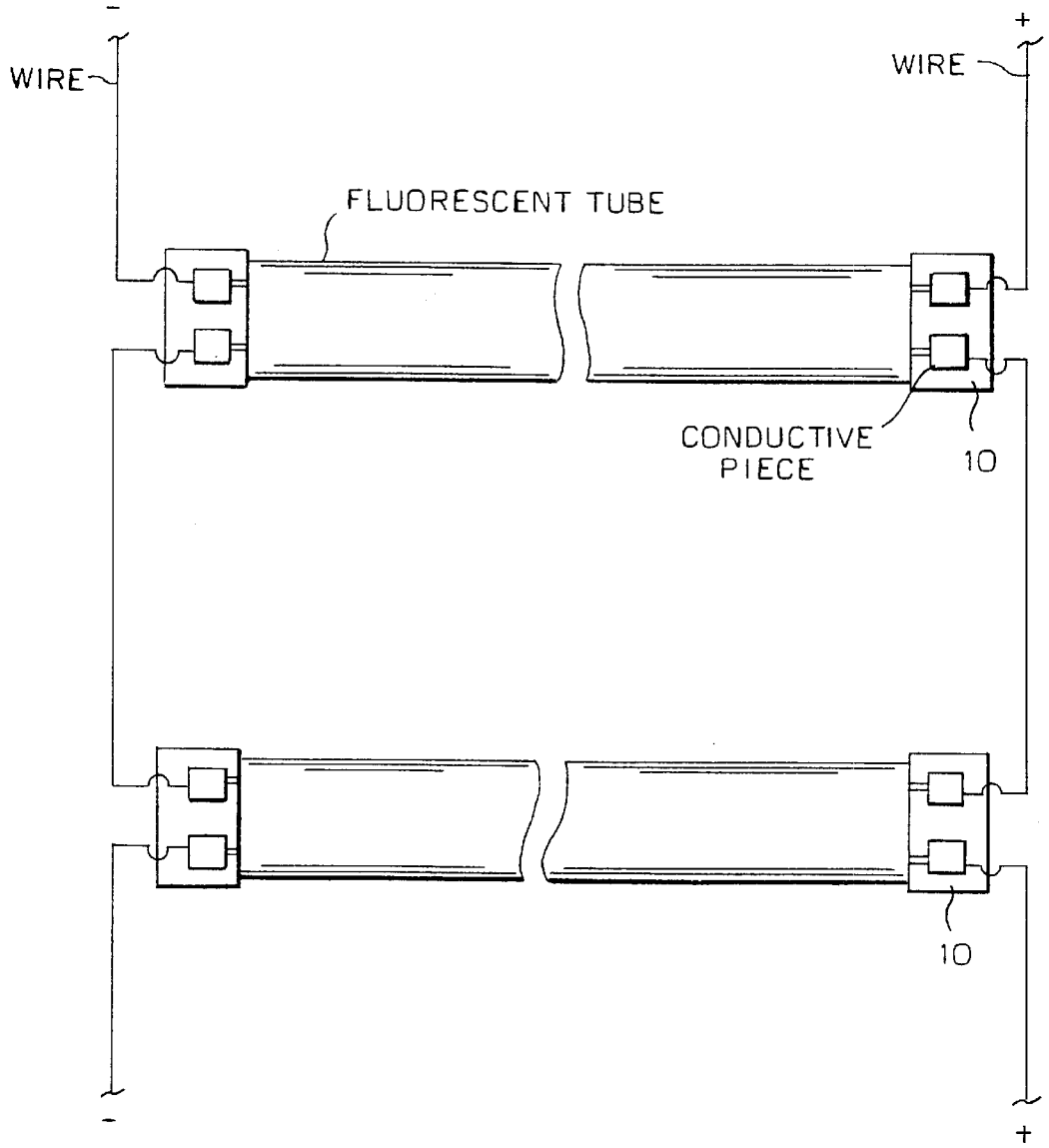
FIG. 5 (PRIOR ART)
FIG. 5 shows a schematic view of the conventional joining of two fluorescent tubes in parallel using the fluorescent tube base according to the invention as shown in FIG. 3.

As shown in FIGS. 2–4, a fluorescent tube base 10 of the preferred embodiment of the present invention comprises. a body 11 and a cover 31.

The body 11 is provided in the interior thereof with a plurality of round holes 13, and two conductive pieces 21 which are connected by a bridging piece 27 permitting the conventional engagement of bases for use in electrically connecting two fluorescent tubes in parallel. The conductive pieces 21 are provided with a through hole 22 for receiving securely a connection end 28 of the conductive bridging piece 27. The. conductive pieces 21 are further provided at one end thereof with a wire holding portion 24 of a curved construction such that the wire holding portion 24 and the body of the conductive pieces 21 form a predetermined angle. The wire holding portion 24 is divided into two wire holding pieces 25, each having a recess 26.

The cover 31 is provided with a plurality of round projections 33 corresponding in location to and engageable with the round holes 13 of the body 11. The cover 31 is detachably joined with the body 11 such that the round projections 33 of the cover 31 are retained in the round holes 13 of the body 11.

As shown in FIG. 4, an electrical wire 39 is inserted into the body 11 via a wire hole 15 of the body 11 such that the wire 39 is guided by the recess 26 of the wire holding pieces 25 to be held securely by the wire holding pieces 25.

The present invention has advantages, which are described hereinafter.

The two conductive pieces of the present invention are connected by the conductive bridging piece, without the use of springs which are susceptible to mental fatigue.

The present invention is relatively simple in construction and can be thus assembled with ease and speed, without the trouble that the springs are prone to eject out of the body.

The wire holding pieces of the conductive pieces of the present invention are capable of holding wire securely in view of the fact that the wire holding pieces have a sufficient width, and that the wire holding pieces are provided with the recess for guiding the wire.

The cover and the body of the present invention are detachably fastened together by the round projections of the cover, which are releasably retained in the round slots of the body.

Using the system described above, the lamp filaments are not used for the usual heating purposes but act solely as terminals or cold cathodes at each end of the lamp (see U.S. Patent to Russel, No. 2,295,757).

What is claimed is:

1. A fluorescent tube base adapted to engage electrical wires comprising:

a body having an interior provided therein with two spaced apart conductive pieces and a conductive bridging piece connecting an upper side of each of said two conductive pieces; and a cover detachably attached to said body;

wherein, each of said two conductive pieces are provided with a through hole on said upper side; and wherein said conductive bridging piece has two connection ends respectively retained in said through holes of said two conductive pieces.

2. The fluorescent tube base as defined in claim 1, wherein at least one of said two conductive pieces is provided with a wire holding portion, said wire holding portion forming a predetermined angle to a body of said conductive piece and having two recesses respectively adapted to engage the electrical wires.

3. The fluorescent tube base as defined in claim 2, wherein said wire holding portion of said conductive piece is divided into two wire holding pieces; and wherein said two recesses are respectively located in said two wire holding pieces.

4. The fluorescent tube base as defined in claim 1, wherein said body is provided with a plurality of round holes; wherein said cover is provided with a plurality of round projections corresponding in location to said round holes; and wherein said cover is detachably attached to said body such that said round projections of said cover are retained in said round slots holes of said body.

5. A fluorescent tube base adapted to engage electrical wires comprising:

a body having an interior provided therein with two conductive pieces and a conductive bridging piece connecting an upper side of each said two conductive pieces; and a cover detachably attached to said body;

wherein each of said two conductive pieces are provided with a through hole on said upper side; and wherein said conductive bridging piece has two connection ends respectively retained in said through holes of said two conductive pieces; and <wherein at least one of said two conductive pieces is provided with a wire holding portion, said wire holding portion forming a predetermined angle to a body of said conductive piece and having two recesses respectively adapted to engage the electrical wires.

6. The fluorescent tube base as defined in claim 5, wherein said wire holding portion of said conductive piece is divided into two wire holding pieces; and wherein said two recesses are respectively located in said two wire holding pieces.

7. The fluorescent tube base as defined in claim 5, wherein said body is provided with a plurality of round holes; wherein said cover is provided with a plurality of round projections corresponding in location to said round holes; and wherein said cover is detachably attached to said body such that said round projections of said cover are retained in said round holes of said body.

8. A fluorescent tube base adapted to engage electrical wires comprising:

a body having an interior provided therein with two conductive pieces and a conductive bridging piece connecting an upper side of each said two conductive pieces; and a cover detachably attached to said body;

wherein each of said two conductive pieces are provided with a through hole on said upper side; and wherein said bridging piece having two connection ends respectively retained in said through holes of said two conductive pieces;

wherein at least one of said two conductive pieces is provided with a wire holding portion, said wire holding portion forming a predetermined angle to a body of said conductive piece and has two recesses respectively adapted to engage the electrical wires; and wherein said wire holding portion of said conductive piece is divided into two wire holding pieces; and wherein said two recesses are respectively located in said two wire holding pieces.

9. The fluorescent tube base as defined in claim 8, wherein said body is provided with a plurality of round slots holes; wherein said cover is provided with a plurality of round projections corresponding in location to said round slots; and wherein said cover is detachably attached to said body such that said round projections of said cover are retained in said round holes of said body.

10. A fluorescent tube base adapted to engage electrical wires comprising:

a body having an interior provided therein with two conductive pieces and a conductive bridging piece connecting an upper side of each said two conductive pieces; and a cover detachably attached to said body;

wherein each of said two conductive pieces are provided with a through hole on said upper side; and wherein said bridging piece has two connection ends respectively retained in said through holes of said two conductive pieces;

wherein at least one of said two conductive pieces is provided with a wire holding portion, said wire holding portion forming a predetermined angle to a body of said conductive piece and having two recesses respectively adapted to engage the electrical wires;

wherein said wire holding portion of said conductive piece is divided into two wire holding pieces; and wherein said two recesses are respectively located in said two wire holding pieces; and wherein said body is provided with a plurality of round holes; wherein said cover is provided with a plurality of round projections corresponding in location to said round holes; and wherein said cover is detachably attached to said body such that said round projections of said cover are retained in said round holes of said body.

* * * * *